US008877042B2

(12) United States Patent
Dean et al.

(10) Patent No.: US 8,877,042 B2
(45) Date of Patent: Nov. 4, 2014

(54) ANCILLARY CRACKING OF HEAVY OILS IN CONJUNCTION WITH FCC UNIT OPERATIONS

(75) Inventors: Christopher F. Dean, Dhahran (SA); Yuichiro Fujiyama, Yokohama (JP); Takata Okuhara, Fujisawa (JP)

(73) Assignees: Saudi Arabian Oil Company, Dhahran (SA); Nippon Oil Corporation, Tokyo (JP)

( * ) Notice: Subject to any disclaimer, the term of this patent is extended or adjusted under 35 U.S.C. 154(b) by 0 days.

(21) Appl. No.: 13/111,437

(22) Filed: May 19, 2011

(65) Prior Publication Data

US 2011/0226668 A1 Sep. 22, 2011

Related U.S. Application Data

(63) Continuation of application No. 11/487,011, filed on Jul. 13, 2006, now abandoned.

(51) Int. Cl.
*C10G 11/18* (2006.01)
*C10G 51/06* (2006.01)

(52) U.S. Cl.
CPC ..... *C10G 51/06* (2013.01); *C10G 2400/20* (2013.01); *C10G 2300/4006* (2013.01); *C10G 11/18* (2013.01); *C10G 2400/02* (2013.01); *C10G 2300/4093* (2013.01)
USPC ..... 208/113; 208/78; 208/80; 208/164

(58) Field of Classification Search
USPC ..... 208/78, 80, 113, 141, 144, 155, 164, 208/197, 223
See application file for complete search history.

(56) References Cited

U.S. PATENT DOCUMENTS 3,424,672 A 1/1969 Mitchell
3,542,667 A 11/1970 Mcmahon et al.

(Continued)

FOREIGN PATENT DOCUMENTS

EP 142900 A2 5/1985
WO 01/44409 A1 6/2001
WO WO 01/44409 * 6/2001 ..... C10G 51/06
WO 2006/020547 A1 2/2006

OTHER PUBLICATIONS

Corma, A. Melo, et al., "Different Process Schemes for Converting Light Straight Run and Fluid Catalytic Cracking Naphthas in A FCC Unit for Maximum Propylene Production," Applied Catalysis A: General; vol. 265, Issue 2, Jul. 8, 2004, pp. 195-206.

(Continued)

*Primary Examiner* — Renee E Robinson
(74) *Attorney, Agent, or Firm* — Abelman, Frayne & Schwab

(57) ABSTRACT

The production of light hydrocarbons consisting of ethylene, propylene, butylenes, and of gasoline is enhanced by introducing a heavy oil feedstream derived from an external source into an ancillary downflow reactor that utilizes the same catalyst composition as an adjacent FCC unit for cracking the heavy oil and withdrawing the desired lighter hydrocarbon reaction product stream from the downflow reactor and regenerating the catalyst in the same regeneration vessel that is used to regenerate the spent catalyst from the FCC unit. The efficiency of the recovery of the desired lighter olefinic hydrocarbons is maximized by limiting the feedstream to the downflow reactor to heavy oils that can be processed under relatively harsher conditions, while minimizing production of undesired by-products.

19 Claims, 2 Drawing Sheets

(56) References Cited

U.S. PATENT DOCUMENTS

| | | | |
|---|---|---|---|
| 3,617,496 | A | 11/1971 | Murphy et al. |
| 3,784,463 | A | 1/1974 | Reynolds et al. |
| 3,856,659 | A | 12/1974 | Owen et al. |
| 3,928,172 | A | 12/1975 | Davis et al. |
| 4,051,013 | A | 9/1977 | Strother |
| 4,090,949 | A | 5/1978 | Owen et al. |
| 4,097,363 | A | 6/1978 | McKinney et al. |
| 4,116,814 | A | 9/1978 | Zahner |
| 4,297,203 | A | 10/1981 | Ford et al. |
| 4,310,489 | A | 1/1982 | Fahrig et al. |
| 4,385,985 | A | 5/1983 | Gross et al. |
| 4,693,808 | A | 9/1987 | Dewitz |
| 4,814,067 | A | 3/1989 | Gartside et al. |
| 4,830,728 | A | 5/1989 | Herbst et al. |
| 5,049,360 | A | 9/1991 | Harandi et al. |
| 5,053,204 | A | 10/1991 | Herbst et al. |
| 5,314,610 | A | 5/1994 | Gartside |
| 5,344,554 | A | 9/1994 | Pontier et al. |
| 5,372,704 | A | 12/1994 | Harandi et al. |
| 5,449,496 | A | 9/1995 | Pontier et al. |
| 5,582,712 | A | 12/1996 | Zinke et al. |
| 5,584,986 | A | 12/1996 | Bartholic |
| 5,730,859 | A | 3/1998 | Johnson et al. |
| 5,846,403 | A | 12/1998 | Swan et al. |
| 5,904,837 | A | 5/1999 | Fujiyama |
| 5,951,850 | A | 9/1999 | Ino et al. |
| 5,965,012 | A | 10/1999 | Lomas |
| 6,045,690 | A | 4/2000 | Fujiyama et al. |
| 6,099,720 | A | 8/2000 | Pontier et al. |
| 6,146,597 | A | 11/2000 | Nishida et al. |
| 6,187,272 | B1 | 2/2001 | Ikeda |
| 6,616,899 | B1 | 9/2003 | Upson |
| 6,641,715 | B1 | 11/2003 | Gauthier |
| 6,656,346 | B2 | 12/2003 | Ino et al. |
| 6,837,989 | B2 | 1/2005 | Stuntz et al. |
| 6,866,771 | B2 | 3/2005 | Lomas et al. |
| 7,220,351 | B1 * | 5/2007 | Pontier et al. ..... 208/113 |
| 2002/0096452 | A1 | 7/2002 | Espeillac et al. |
| 2002/0195373 | A1 * | 12/2002 | Ino et al. ..... 208/113 |
| 2004/0004025 | A1 | 1/2004 | Xu et al. |
| 2004/0110629 | A1 * | 6/2004 | Stamires et al. ..... 502/60 |
| 2004/0124124 | A1 | 7/2004 | Pinho et al. |
| 2005/0167333 | A1 | 8/2005 | McCall et al. |
| 2008/0011644 | A1 | 1/2008 | Dean et al. |

OTHER PUBLICATIONS

Pinho, A., et al., "Pioneering FCC Process in Down-Flow for Light Olefins," Presented during Scope 2004 Conference, Florence, Italy, Jun. 21-23, 2004, pp. 1-9.

Al-Tayyar, H. Mohammad, et al., "Development of a Novel Refinery Process: From Laboratory Experiments to Commercial Applications," Saudi Aramco Journal of Technology, Spring 2008, pp. 2-9.

PCT/US2007/15950, International Search Report and Written Opinion dated Dec. 3, 2007, 2 pages.

PCT/US2007/16054, International Search Report and Written Opinion dated Dec. 6, 2007, 2 pages.

Yatsuzuka et al., "Development of HS-FCC (High-Severity FCC) Process", *2000 International 5, Petroleum Energy Center*, 2000, pp. 1-5.

Fujiyama et al., "Demonstration Plant for New FCC Technology Yields Increased Propylene", *Oil & Gas Journal*, Sep. 26, 2005, pp. 54-58.

Fujiyama et al., Development of High-Severity FCC Process: An Overview, *Studies in Surface Science and Catalysis*, vol. 166, 2007, pp. 1-12 (Abstract only).

European Seach Report in EP 07796864.2 dated Oct. 13, 2011.

* cited by examiner

ANCILLARY CRACKING OF HEAVY OILS IN CONJUNCTION WITH FCC UNIT OPERATIONS

RELATED APPLICATION INFORMATION

This application is a continuation of U.S. application Ser. No. 11/487,011, which is to be abandoned.

FIELD OF THE INVENTION

This invention relates to the processing of heavy hydrocarbons, such as gasoils, vacuum gasoils and residues for the purpose of increasing the production of lighter hydrocarbons, such as ethylene, propylene and the butylenes, and gasoline in conjunction with the operation of a fluidized catalytic cracking process.

BACKGROUND OF THE INVENTION

Propylene is second in importance only to ethylene as a petrochemical raw material building block. Propylene has traditionally been obtained as a by-product from steam cracking to produce ethylene and from refinery fluidized catalytic cracking processes to produce gasoline. The projected growth in demand for propylene has started to exceed that of ethylene so that existing processes cannot satisfy the foreseeable future growth in the demand for propylene.

Fluidized catalytic cracking, or FCC, is a well-known and widely practiced process for converting heavy hydrocarbons, gasoils and residues into lighter hydrocarbon fractions. The process for the catalytic cracking of heavy hydrocarbons, gasoils and residues is well known and currently practiced in all types of FCC units processing a variety of these feedstocks.

In general terms, the process for the cracking of hydrocarbon feedstocks relies on contact with fluidized catalytic particles in a reaction zone maintained at appropriate temperatures and pressures. When the heavier feed contacts the catalyst and is cracked to lighter products, carbonaceous deposits, commonly referred to as coke, form on the catalyst and deactivate it. The deactivated, or spent, catalyst is separated from the cracked products, stripped of removable hydrocarbons and passed to a regeneration vessel where the coke is burned from the catalyst in the presence of air to produce a substantially regenerated catalyst. The combustion products are removed from the vessel as flue gas. The regenerated and heated catalyst is then recycled to the FCC unit. A general description of the process as related to catalytic cracking with short duration contact times is provided in U.S. Pat. No. 3,074,878, the complete disclosure of which is incorporated herein by reference.

Various methods and apparatus have been proposed for increasing or enhancing the output of particular product streams from the FCC unit. In some cases, ancillary reactors and other treatment vessels have been provided to treat a particular fraction or reaction product stream. In some instances, multiple reactors are provided, each with a different feed, in order to derive a particularly desired product stream.

It is known from the prior art to employ a downflow reactor for processing various grades of oil, including heavy oils. It is also known to recover light olefins, e.g., ethylene, profylene and butane, and gasoline product streams from a downflow reactor along with other reaction products and unreacted feed.

A downflow reaction zone is described in U.S. Pat. No. 5,904,837 for the fluid catalytic cracking of oils, including straight-run and cracked gas oils, vacuum gas oil (VGO), atmospheric and reduced-pressure distillation residues and heavy fraction oils obtained by hydrorefining the residues and gas oils, either individually or as mixtures. The process employs a downflow type reaction zone, a separation zone, a catalyst stripping zone and a catalyst regeneration zone. The use of a temperature controlling quench oil at the outlet of the reactor is also disclosed. The principal product stream obtained was gasoline, e.g., about 38%-40% of the yield with a maximum of 16% propylene.

Another downflow FCC process is disclosed in U.S. Pat. No. 5,951,850 in which process conditions, reaction zone temperature, catalyst/oil ratios and catalyst regeneration zone temperatures are controlled to crack a variety of heavy fraction oils to provide relatively less dry gases, such as hydrogen, methane and ethane, and provide relatively higher yields of light fraction olefins. The use of more severe operating conditions, i.e., reaction temperatures and catalyst/oil ratios, produces somewhat more light olefins at the expense of reduced gasoline products in this FCC process.

Another method for operating a downflow FCC reactor for use in the processing of gas oil or heavy oil is disclosed in U.S. Pat. No. 6,656,346 and affords the recovery of significant quantities of light olefins. In this process, two types of zeolites are employed, the reaction zone temperature range is narrower than was disclosed in U.S. Pat. No. 5,951,850 and the contact time is shorter. Conversion to propylene ranged from about 20% to almost 24% by weight of the total conversion yield.

Each of the above downflow FCC unit operations includes a catalyst regeneration vessel to burn the coke from the spent catalyst and raise the temperature of the catalyst to provide heat for the endothermic cracking reaction.

The prior art relating to FCC apparatus and processes also includes examples of multiple reactor stages that are provided with different feedstocks that can be used to produce product streams containing light olefins. However, none of these disclosures provides a solution to the problem of enhancing the production of light olefins, and particularly of propylene in significant measure as an adjunct to existing FCC unit processes.

It is therefore an object of the present invention to provide a process in which a feedstream from an external source, such as heavy oil or from the same oil feedstock used in the FCC process, is further cracked to provide an enhanced light reaction product stream.

It is a further object of the invention to provide such a process that can be run efficiently utilizing the same catalyst employed in the FCC unit.

Yet another object of the invention is to provide a novel process for efficiently cracking a heavy hydrocarbon, gasoil and/or resid oil feedstock to produce a lighter hydrocarbon product stream consisting of ethylene, propylene, butylenes, and gasoline, which reaction product stream can either be recovered separately and further fractionated to recover the individual components or combined with an effluent stream from the FCC unit for further fractionation.

The term "heavy oil feed" shall be understood to include any hydrocarbon charge stock boiling in the range of 600° F. to 1050° F., or higher.

SUMMARY OF THE INVENTION

The above objects and other advantages are achieved by the improved process and apparatus of the invention in which a downward flow fluidized catalyst reactor is added as an ancillary reactor to an existing FCC process unit operation. The ancillary downflow reactor system utilizes the same hot regenerated catalyst as is used in the FCC unit, thereby minimizing capital investment for new equipment and operating costs. The regenerated catalyst and a heavy hydrocarbon or gasoil feedstream that can be derived from a source that is the same as, or independent of the FCC unit are introduced and thoroughly mixed in an upper portion of the downflow reactor that is above the reaction zone.

The mixture passes through the reaction zone with a residence time of 0.1 seconds to 5 seconds, and preferably in a range of 0.2 seconds to 2 seconds. The reaction zone operating temperature can be in the range from 990° F. to 1,300° F. The ratio of catalyst-to-oil, or catalyst/oil ratio, in the reaction zone is in the range of from 10 percent to 50 percent by weight, with a preferred operating range of from 20 percent to 40 percent by weight. The determination of the catalyst-to-oil ratio is an indication of operating severity and the determination of the optimum value is well within the ordinary skill in the art.

The ancillary downflow reactor can be of the same or a different capacity than the FCC reactor. As will be understood by one of ordinary skill in the art, the coke produced and deposited on the catalyst in the downflow reactor of the invention will be sufficient when burned in the regenerator to raise the temperature of the regenerated coke for use in either the FCC unit or the ancillary downflow unit.

A design factor that is to be considered is that the regenerator vessel be able to maintain the throughput necessary to supply regenerated catalyst to both the FCC unit and the ancillary downflow reactor. The management and control of the throughput of both the catalyst material and the feedstock and the control of the catalyst temperature in, and issuing from the regenerator is also within the skill of the art and includes automated control systems. As will also be apparent to those of ordinary skill in the art, the quality and condition of the catalyst material(s) must also be routinely monitored, particularly where severe conditions are imposed in cracking one or more heavy oil feedstocks, in one or both of the reactors.

The efficient operation of the auxiliary process of the invention is dependent upon the optimization of cracking conditions for a given feedstream that consists of one or more heavy hydrocarbon feeds. The relatively low residence times and higher catalyst-to-oil ratios of 20 to 40 percent by weight when compared to the FCC primary reaction zone are specific to the heavy hydrocarbon feedstream.

It will therefore be understood that the present invention broadly comprehends a method of producing a product stream consisting primarily of the light olefins ethylene, propylene and butylenes, and of gasoline in conjunction with the processing of a separate petroleum feedstock in a fluidized catalytic cracking (FCC) unit containing a catalyst of specified composition, the FCC and associated downflow reactor catalyst feed being regenerated from spent catalyst, and the method including the steps of:

a. providing a separate heavy oil feedstream and directing it into an upper portion of a downflow reactor that is proximate the FCC unit;
b. introducing hot regenerated catalyst of the same type used in the FCC unit into the downflow reactor for mixing with the heavy oil feedstream in a ratio of catalyst-to-feedstream in the range from 10 percent to 50 percent by weight;
c. passing the catalyst and heavy oil mixture through a reaction zone in the downflow reactor that is maintained at a temperature that ranges from 990° F. to 1300° F. for a residence time of from 0.1 seconds to 5 seconds to crack the heavy oil;
d. separating the reaction products stream containing light olefins, gasoline and unreacted feed from spent catalyst;
e. recovering the reaction product stream; and
f. passing the spent catalyst from the downflow reactor to a separate regeneration vessel that also contains spent catalyst from the FCC unit for regeneration and recycling to the FCC unit and the downflow reactor.

Downflow reactors that are suitable for use in the practice of the invention are known in the art. One example of such a reactor is described in U.S. Pat. No. 5,904,837 (the '837 patent), the disclosure of which is incorporated herein by reference in its entirety. It will be understood that the '837 disclosure is directed to an FCC unit process which necessarily includes a regeneration vessel, while the present invention is distinguished by its utilization of an existing regenerator.

A second example of a suitable downflow reactor is described in U.S. Pat. No. 6,045,690 (the '690 patent) and is directed to an FCC unit operation using the downflow reactor and, as such, is also distinguished from the present improvement that is used in association with an FCC unit's catalyst regenerator. In the downflow reactor of the '690 patent, regenerated catalyst is introduced at two locations in the reaction zone: a regenerated catalyst is introduced at the reaction zone inlet and mixed with heavy oil, while a second portion of regenerated catalyst is introduced in at least one intermediate position between the inlet and outlet of the reaction zone. A quench oil is also optionally introduced near the outlet of the reactor to lower the temperature of the reaction mixture of cracked products, unreacted hydrocarbons and catalyst. This quench oil is a recovered fraction having a boiling point of at least about 570° F.

The improved ancillary process of the invention can be utilized with prior art FCC units, whether they employ riser cracking in an upward or downward flow reaction scheme, or bed cracking, to catalytically convert the feedstock into the desired lighter hydrocarbons, and particularly to provide an enhanced propylene yield for the overall unit operation.

The hydrocarbon feedstocks that can be utilized in the ancillary downflow reactor processing can include those boiling in the range from 600° F. to 1050° F., and preferably from 650° F. to 1050° F., as initial and final boiling point temperatures. These feedstocks are commonly referred to in the art as straight-run gasoils, vacuum gasoils, residues from atmospheric and vacuum distillation columns and cracked gasoil from refinery processes. Preferred for use in the ancillary downflow reactor of the invention are heavy oils derived from hydrocracking and hydrotreating processes. The feedstocks can be used alone or combined for treatment in the downflow reactor in accordance with the invention.

Any existing FCC catalyst can be employed in the practice of the improved process of the invention. Typical FCC catalysts with, or without catalyst additives are suitable for use in this process enhancement.

In order to optimize separation of the catalyst from the products and unreacted starting material(s), a rapid separation is preferred. A suitable device that can achieve the desired rapid separation is disclosed in U.S. Pat. No. 6,146,597 (the '597 patent), the disclosure of which is incorporated herein in its entirety by reference.

BRIEF DESCRIPTION OF THE DRAWINGS

The apparatus and method of the invention will be described in further detail below and with reference to the attached drawings where the same or similar elements are referred to by the same numerals, and in which.

DETAILED DESCRIPTION OF THE PREFERRED EMBODIMENTS

Figure 1:
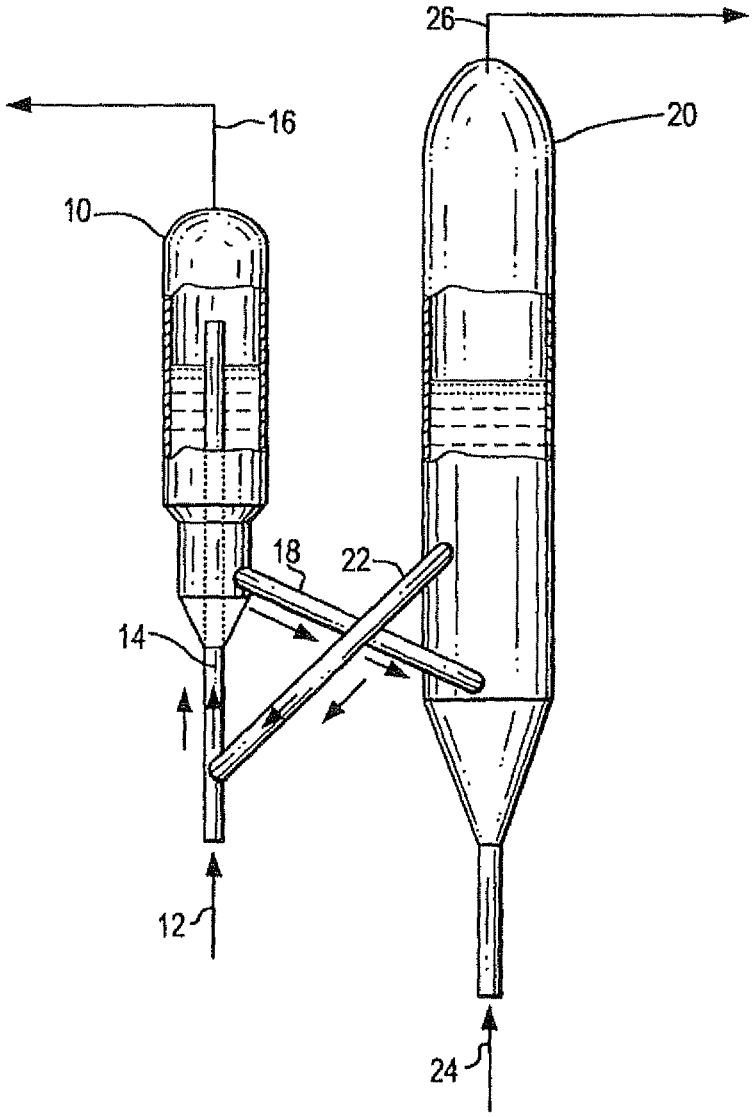
FIG. 1 PRIOR ART
FIG. 1 is a simplified schematic illustration of a typical FCC apparatus and process of the prior art.

As indicated above, the method and apparatus of the present invention can be employed with any number of FCC process units known to the prior art. With reference to FIG. 1, a typical prior art FCC process is schematically illustrated. The reactor vessel (10) receives the hydrocarbon, or oil, feedstock (12) that is admitted into the lower end of reactor riser (14) where it is mixed with fresh and/or regenerated catalyst that is transferred by a conduit (22). For the purpose of this simplified schematic illustration and description, the numerous valves, temperature sensors, electronic controllers and the like that are customarily employed and well known to those of ordinary skill in the art are not included in order to focus on the principal features of the present invention.

In this continuous process, the mixture of catalyst and FCC reactor feedstream proceed upward through the riser into a reaction zone in which the temperature, pressure and residence time are controlled within ranges that are conventional and related to the operating characteristics of the one or more catalysts used in the process, the configuration of the apparatus, the type and characteristics of the feedstock and a variety of other parameters that are well known to those of ordinary skill in the art and which form no part of the present invention. The reaction product is withdrawn through conduit (16) for recovery and/or further processing in the refinery.

The spent catalyst from the FCC unit is withdrawn via transfer line (18) for delivery to the lower portion of regeneration vessel (20), most conveniently located in relatively close proximity to FCC unit (10). The spent catalyst entering through transfer line (18) is contacted by at least a stream of air admitted through conduit (24) for controlled combustion of accumulated coke. The flue gases are removed from the regenerator (20) via conduit (26), and the temperature of the regenerated catalyst is raised by the combustion of the coke to provide heat for the endothermic cracking reaction.

Figure 2:
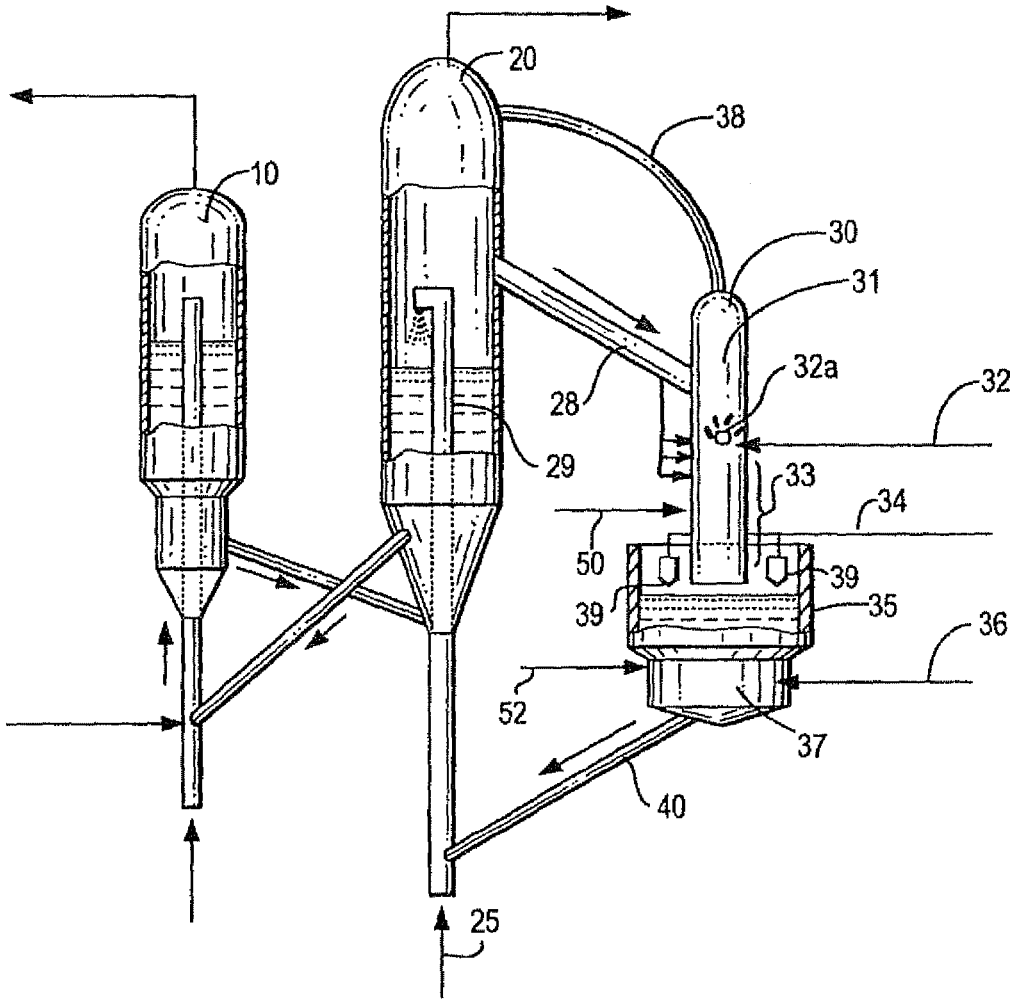
FIG. 2 is a simplified schematic illustration of an embodiment of the apparatus and process of the present invention.

Referring now to FIG. 2, it will be understood that the reactor (10) and regeneration vessel (20) include components common to those described in connection with FIG. 1 and their description and functioning will not be repeated. The novel apparatus component and method of operation depicted in FIG. 2 is the downflow reactor (30) which receives hot regenerated catalyst via transfer line (28) that is introduced into an upper portion of the vessel at a temperature in the range of 1250° F. to 1500° F. The hot catalyst is received in a withdrawal well or hopper where it stabilizes before being introduced into the downflow reaction zone (33). Feedline (32) introduces a heavy oil feedstream (32) that can be the same in whole or in part as the feedstock to the FCC unit or a different heavy oil or mixture of heavy oils as described above. Feedstream (32) is mixed with the incoming stabilized regenerated catalyst from the hopper that is fed by gravity. The heavy oil is preferably introduced via nozzles (31) to facilitate uniform mixing. The mixture of heavy oil and catalyst passes into a reaction zone (33) that is maintained at a temperature that ranges from about 990° F. to 1,300° F. The catalyst/oil ratio is preferably in the range of from 20 percent to 40 percent by weight. The residence time of the mixture in the reaction zone is from about 0.2 seconds to about 2 seconds.

Although a variety of catalysts can be utilized in the process, it will be understood that the same catalyst used in the main FCC unit is also employed in the catalytic cracking of the heavy oil feedstream in the ancillary downflow reactor (30). Typical FCC units utilize zeolites, silica-alumina, carbon monoxide burning promoter additives, bottom cracking additives and light olefin promoting additives. In the practice of the invention it is preferred that zeolite catalysts of the Y, REY, USY and RE-USY types be used alone or in combination with a ZSM-5 catalyst additive. As will be understood by those of ordinary skill in this art, the catalysts and additives are preferably selected to maximize and optimize the production of light olefins and gasoline. The choice of the catalyst(s) system does not form a part of the present invention.

With continuing reference to FIG. 2, the light reaction product stream is recovered via line (34). In accordance with the method of the invention, the light hydrocarbon reaction product stream containing ethylene, propylene, butylenes, gasoline and any other by-products from the cracking reactions and unreacted feed, is withdrawn and can be either recovered separately in a segregated recovery section or combined with the reaction product stream from the FCC unit for further fractionation and eventual recovery. This is a particular advantage of the present process and provides the refinery operation with options based upon such variables as feedstream availability, specific product demand, downstream refining and/or other processing capacity and output from the principal FCC unit (10).

Stripping steam is admitted through line (36) to drive off any removable hydrocarbons from the spent catalyst. The product gases are discharged from the reaction zone (33) of the downflow reactor (30) and introduced into the upper portion of the stripper vessel (37) where they combine with the stripping steam and other gases and vapors and pass through cyclone separators (39) and out of the stripper vessel via product line (34) for product recovery in accordance with methods known to the art.

The spent catalyst recovered from the downflow reactor (30) is discharged through transfer line (40) and admitted to the lower end of the diptube, or lift riser, (29) which extends from the catalyst regenerator (20) that has been modified in accordance with the method of this invention. In this embodiment, air is introduced below the spent catalyst transfer line (40) at the end of diptube or lift riser (29) via pressurized air line (25). A more detailed description of the functioning of the secondary downflow reactor is provided below.

The configuration and selection of materials for the downflow reactor (30), as well as the specific operating characteristics and parameters will be dependent upon the specific qualities and flow rate of the heavy oil feed introduced at the feedstock line (32), which in turn will be dependent upon the source of the feedstock. More detailed operating conditions are set forth below.

With continuing reference to FIG. 2, the hot regenerated catalyst at approximately 1250° F. to 1500° F. is transferred from the regenerator vessel (20) of the FCC process by conventional means, e.g., through a downwardly directed conduit or pipe (28), commonly referred to as a transfer line or standpipe, to a withdrawal well or hopper (31) at the top of the downflow reactor above the reaction zone (33) where the hot catalyst flow is allowed to stabilize in order to be uniform when it is directed into the mix zone or feed injection portion of the reaction zone (33). A pressure stabilization line (38) connects the top of the withdrawal well (31) to the existing regenerator (20).

The reaction temperature, i.e., the outlet temperature of the downflow reactor, is controlled by opening and closing a catalyst slide valve (not shown) that controls the flow of regenerated catalyst from the withdrawal well (31) and into the mix zone. The heat required for the endothermic cracking reaction is supplied by the regenerated catalyst. By changing the flow rate of the hot regenerated catalyst, the operating severity or cracking conditions can be controlled to produce the desired yields of light olefinic hydrocarbons and gasoline.

The heavy oil feedstock (32) is injected into the mixing zone through feed injection nozzles (32*a*) placed in the immediate vicinity of the point of introduction of the regenerated catalyst into the downflow reactor (30). These multiple injection nozzles (32*a*) result in the catalyst and oil being mixed thoroughly and uniformly. Once the feedstock contacts the hot catalyst the cracking reactions occur. The reaction vapor of hydrocarbon cracked products and unreacted heavy oil feed and catalyst mixture quickly flows through the remainder of the downflow reactor and into a rapid separation section (35) at the bottom portion of the reactor. The residence time of the mixture in the reaction zone is controlled in accordance with apparatus and procedures known to the art.

If necessary for temperature control, a quench injection (50) is provided near the bottom of the reaction zone (33) immediately before the separator. This quench injection quickly reduces or stops the cracking reactions and can be utilized for controlling cracking severity and allows for added process flexibility.

The rapid separator (35) along with the end portion of the downflow reactor (30) is housed in the upper section of a large vessel referred to as the catalyst stripper (37). The rapid separator directs the reaction vapor and catalyst directly into the top part the stripper vessel (37).

The reaction vapors move upwardly from the rapid separator outlet into the stripper, combine with stripped hydrocarbon product vapors and stripping gas from the catalyst stripping section of this vessel and pass through conventional separating means such as one or more cyclones (39), which further separate any entrained catalyst particles from the vapors. The catalyst from the separator that is captured in the cyclones is directed to the bottom of the stripper vessel (37) through a cyclone dipleg for discharge into the bed of catalyst that was recovered from the rapid separator in the stripping section.

After the combined vapor stream passes through the cyclones and out of the stripper vessel, it is directed through a conduit or pipe commonly referred to as a reactor vapor line (34) to a conventional product recovery section known in the FCC art.

The catalyst from the rapid separator and cyclone diplegs flows to the lower section of the stripper vessel that includes a catalyst stripping section into which a suitable stripping gas, such as steam, is introduced through line (36). The stripping section is provided with several baffles or structured packing (not shown) over which the downwardly flowing catalyst passes counter-currently to the flowing stripping gas. The upwardly flowing stripping gas, which is typically steam, is used to remove any additional hydrocarbons that remain in the catalyst pores or between catalyst particles.

The stripped catalyst is transported by the combustion air stream (25) through a lift riser (29) that terminates in the existing, but modified, regenerator (20) in a typical FCC process to burn off any coke that is a by-product of the cracking process. In the regenerator, the heat produced from the combustion of the by-product coke produced in the first reaction zone (10 and 14) of a typical FCC process from cracking heavy hydrocarbons and from the heavy oil cracking in zone (33) of the downflow reactor (30) is transferred to the catalyst.

The regenerator vessel (20) can be of any conventional previously known design and can be used with the enhanced process and downflow reaction zone of this invention. When modified for the practice of the invention, the placement of the regenerator-to-reactor conduit (28) or regenerated catalyst transfer line for the regenerator will be such that it insures a steady and continuous flow of a substantial quantity of regenerated catalyst that is needed to meet the maximum design requirements of the downflow reactor.

The catalyst requirements for the process of the invention can be determined in conjunction with any catalyst conventionally used in FCC processes, e.g., zeolites, silica-alumina, carbon monoxide burning promoter additives, bottoms cracking additives, light olefin-producing additives and any other catalyst additives routinely used in the FCC process. The preferred cracking zeolites in the FCC process are zeolites Y, REY, USY, and RE-USY. For the entranced production of light olefins, a preferred shaped selective catalyst additive typically used in the FCC process to produce light olefins and increase FCC gasoline octane is ZSM-5 zeolite crystal or other pentasil type catalyst structure. This ZSM-5 additive is mixed with the cracking catalyst zeolites and matrix structures in the conventional FCC catalyst and is preferably used in the method of the invention to maximize and optimize light olefin production in the ancillary downflow reactor.

A particular advantage of the present invention as an enhancement to existing FCC processes for co-processing heavy oils is that separate recovery of the products from each reactor for further downstream processing can be provided. The method and apparatus of the invention provides enhanced product recovery in conjunction with the existing FCC reactor thereby effectively increasing the overall capacity of the FCC unit process to produce more light olefins to meet the growing commercial demands described above. In addition, the process has the advantage that the products can be recovered in the existing section of the FCC unit without the need for additional facilities and capital expenditures.

The following comparative example illustrates the improvement in product yield when an existing convention FCC unit is provided with the enhancement of the down flow reactor of the present invention to increase the yield of light olefins. The product yields are typical for an FCC unit operating on unhydrotreated Middle East vacuum gasoil (VGO) feedstock. The downflow reactor yields are based on a bench scale pilot plant results representing the cracking conditions in the downflow reactor using hydrotreated Middle East vacuum gasoil. In this example the catalyst systems are similar and use USY zeolite.

The following Table summarizes the yield improvement in the production of light olefins when utilizing the downflow enhancement with a feedstock that is different than the feedstock provided to the conventional FCC unit.

| | FCC Unit | Enhancement |
|---|---|---|
| Reactor Type | Upflow Riser | Downflow Type |
| Catalyst Type | USY | USY |
| | Middle East VGO | Hydrotreated Middle East |

-continued

| Feed Stock | Untreated | VGO |
|---|---|---|
| API Gravity | 23.2 | 26.2 |
| Density g/cm3 | 0.9147 | 0.8972 |
| Sulfur wt. % | 2.5 | 0.13 |
| Con, Carbon wt. % | 0.92 | 0.15 |
| Operating Conditions | | |
| Reactor Outlet | 980° F. (527° C.) | 1112° F (600° C.) |
| Cat/oil Ratio | 8.6 | 40 |
| Product Yields | Wt % | Wt. % |
| H2S | 1.03 | 0.07 |
| H2 | 0.06 | 0.08 |
| 01 | 0.79 | 1.18 |
| C2 | 0.74 | 0.94 |
| C2 = | 0.68 | 4.10 |
| C3 | 1.54 | 1.75 |
| C3 = | 3.93 | 19.67 |
| IC4 | 2.80 | 2.60 |
| nC4 | 0.98 | 0.82 |
| C4 = | 5.80 | 16.09 |
| Gasoline | 52.56 | 32.80 |
| Light Cycle Oil | 14.28 | 8.13 |
| Slurry | 9.50 | 5.87 |
| Coke | 5.32 | 5.92 |
| Conversion %* | 76.22 | 86.00 |

*Conversion is an indication of operating severity and is defined as:

$$\% = \frac{100 - (\text{Light cycle oil} + \text{slurry})}{100}$$

As reported in the table, the total weight percent of the light olefins ($C_2$, $C_3$ and $C_4$) produced in the conventional FCC unit was 10.41, while the method of the invention increased the yield of these compounds to 39.86 weight percent.

These comparative examples also indicate that two different feedstocks can be introduced and the processes operated at different severities in order to produce these yields.

It will be understood that the embodiments described above are illustrative of the invention and that various modifications can be made by those of ordinary skill in the art that will be within the scope of the invention, which is to be determined by the claims that follow.

We claim:

1. A method of enhancing the conversion of a heavy oil feedstream derived from a crude distillation unit into a lighter hydrocarbon product stream consisting of ethylene, propylene, butylenes and gasoline, and the recovery of the lighter hydrocarbon products as a separate stream, the method comprising:

a. directing a separate feedstream of the heavy oil into the top of an ancillary downflow reactor that contains fresh or regenerated hot catalyst of the same composition as the catalyst used in an FCC unit with which the downflow reactor is associated;

b. introducing the heavy oil through a plurality of injection nozzles into a mixing zone and into contact with a controlled flow of the hot catalyst to provide a uniform mixture;

c. operating the downflow reactor with a residence time of the heavy oil and Catalyst mixture in a reaction zone of from 0.1 seconds to 5 seconds at an operating temperature in the range of 990° F. to 1300° F. and with a catalyst-to-heavy oil ratio in the range from 25:1 to 50:1 by weight to produce the lighter hydrocarbon reaction products by cracking the heavy oil feedstream;

d. separating the lighter hydrocarbon reaction product stream produced in the downflow reactor cracking process from spent catalyst downstream of the reaction zone;

e. recovering the lighter hydrocarbon reaction product steam produced in the downflow reactor cracking process from spent catalyst in a rapid separation section that is downstream of the reaction zone;

f. recovering the lighter hydrocarbon reaction products as a separate stream; and g. combining and commingling the spent catalyst from the downflow reactor with spent catalyst from the FCC unit and regenerating the combined spent catalysts for reuse in the FCC unit and the downflow reactor.

2. The method of claim 1, wherein the downflow reactor is operated with a feedstream residence time in the range of from 0.2 seconds to 2 seconds.

3. The method of claim 1, wherein the catalyst-to-heavy oil ratio is in the range of from 25:1 to 40:1 by weight.

4. The method of claim 1, wherein the recovered lighter hydrocarbon reaction product stream from the downflow reactor is subjected to fractionation.

5. The method of claim 1, wherein the recovered lighter hydrocarbon reaction product stream from the downflow reactor is combined with an effluent stream from the FCC unit for fractionation.

6. The method of claim 1 which is operated continuously.

7. The method of claim 1 in which the hydrocarbon reaction product stream is separated from the spent catalyst by a cyclone separator process.

8. The method of claim 1 which includes applying a quenching fluid to the reaction product and catalyst below the reaction zone.

9. The method of claim 1 which includes stripping the spent catalyst downstream of the reaction zone.

10. The method of claim 1, wherein the flow rate of hot catalyst into mixing zone of the downflow reactor is adjusted to control the temperature in the reaction zone.

11. The method of claim 1 which includes stabilizing the temperature of the hot catalyst prior to its controlled introduction into the reaction mixing zone.

12. The method of claim 1, wherein the lighter hydrocarbon reaction product stream contains a greater combined proportion of the olefins ethylene, propylene and butylenes as compared to a product stream from the associated FCC unit, and propylene constitutes the major component of the olefins in the lighter hydrocarbon product stream.

13. A method of producing and recovering a separate product stream consisting primarily of the light olefins ethylene, propylene and butylenes, and gasoline in conjunction with the processing of a petroleum feedstock in a fluidized catalytic cracking (FCC) unit containing a catalyst of specified composition, the catalyst used in the FCC unit being regenerated from spent catalyst, the method comprising:

a. introducing a separate heavy oil feedstream into an upper portion of a downflow reactor that is proximate the FCC unit;

b. introducing regenerated catalyst of the same type used in the FCC unit into the downflow reactor for mixing with the heavy oil feedstream in a ratio of catalyst-to-heavy oil feedstream of from 25:1 to 50:1 by weight;

c. passing the catalyst and heavy oil mixture through a reaction zone in the downflow reactor that is maintained at a temperature in the range of from 990° F. to 1300° F. for a residence time of from 0.1 seconds to 5 seconds;

d. separating the resulting reaction product stream of light olefins and gasoline from spent catalyst;

e. recovering the light olefins and gasoline reaction products as a separate stream, wherein the reaction product stream contains a greater combined proportion of the olefins ethylene, propylene and butylenes as compared to a product stream from the proximate FCC unit, and propylene constitutes the major component of the olefins in the lighter hydrocarbon product stream; and f. passing the spent catalyst from the downflow reactor to a separate regeneration vessel that also contains spent catalyst from the FCC unit for regeneration.

14. The method of claim 13, wherein the downflow reactor is operated with a feedstream residence time in the range of from 0.2 seconds to 2 seconds.

15. The method of claim 13, wherein the catalyst-to-feedstream ratio is in the range of from 25:1 to 40:1 by weight.

16. The method of claim 13, wherein the separately recovered reaction product stream from the downflow reactor is combined with an effluent stream from the FCC unit for fractionation.

17. The method of claim 13, wherein the separately recovered reaction product stream from the downflow reactor is subjected to fractionation.

18. The method of claim 13, wherein the flow rate of hot catalyst into the mixing zone of the downflow reactor is adjusted to control the temperature in the reaction zone.

19. The method of claim 13 which includes stabilizing the temperature of the hot catalyst prior to its controlled introduction into the reaction mixing zone.

* * * * *